US006257424B1

(12) United States Patent
Miller

(10) Patent No.: US 6,257,424 B1
(45) Date of Patent: Jul. 10, 2001

(54) HANGING SYSTEM FOR WET BATHING SUITS

(76) Inventor: Ralph Miller, 2101 E. Marquette Dr., Gilbert, AZ (US) 85234

( * ) Notice: Subject to any disclaimer, the term of this patent is extended or adjusted under 35 U.S.C. 154(b) by 0 days.

(21) Appl. No.: 08/953,872

(22) Filed: Oct. 18, 1997

(51) Int. Cl.[7] ..... A47F 5/00
(52) U.S. Cl. ..... 211/87.01; 211/32
(58) Field of Search ..... 211/32, 87.01, 211/41.3, 63

(56) References Cited

U.S. PATENT DOCUMENTS 715,563 * 12/1902 Doublat ..... 211/85.3 X
799,931 * 9/1905 Nordenstiema ..... 211/63
1,716,863 * 6/1929 Morris et al. ..... 211/41.1
3,938,667 * 2/1976 Buckland ..... 211/85.3 X
4,485,929 * 12/1984 Betts ..... 211/59.1

* cited by examiner

*Primary Examiner*—Robert W. Gibson, Jr.

(57) ABSTRACT

A hanging system for wet bathing suits including a support plate. A trough portion is secured to the support plate upwardly of a lower edge thereof. A plurality of support rods extend orthogonally outward from the support plate downwardly of an upper edge thereof for supporting clothing thereon.

5 Claims, 2 Drawing Sheets

HANGING SYSTEM FOR WET BATHING SUITS

BACKGROUND OF THE INVENTION

1. Field of the Invention

The present invention relates to a hanging system for wet bathing suits and more particularly pertains to supporting wet bathing suits to allow for them to dry out without dripping on a floor area with a hanging system for wet bathing suits.

2. Description of the Prior Art

The use of drip catching devices is known in the prior art. More specifically, drip catching devices heretofore devised and utilized for the purpose of catching dripping water are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,378,866 to Pelavin; U.S. Pat. No. 1,999,064 to Marks; U.S. Pat. No. 2,990,033 to Arnold; U.S. Pat. No. 3,141,522 to Fitzpatrick; U.S. Pat. No. 3,284,273 to Prentice; and U.S. Pat. No. 3,282,381 to Fitzpatrick.

While these devices fulfill their respective, particular objective and requirements, the aforementioned patents do not describe a hanging system for wet bathing suits for supporting wet bathing suits to allow for them to dry out without dripping on a floor area.

In this respect, the hanging system for wet bathing suits according to the present invention substantially departs from the conventional concepts and designs of the prior art, and in doing so provides an apparatus primarily developed for the purpose of supporting wet bathing suits to allow for them to dry out without dripping on a floor area.

Therefore, it can be appreciated that there exists a continuing need for new and improved hanging system for wet bathing suits which can be used for supporting wet bathing suits to allow for them to dry out without dripping on a floor area. In this regard, the present invention substantially fulfills this need.

SUMMARY OF THE INVENTION

In the view of the foregoing disadvantages inherent in the known types of drip catching devices now present in the prior art, the present invention provides an improved hanging system for wet bathing suits. As such, the general purpose of the present invention, which will be described subsequently in greater detail, is to provide a new and improved hanging system for wet bathing suits and method which has all the advantages of the prior art and none of the disadvantages.

To attain this, the present invention essentially comprises a support plate having a generally rectangular configuration. The support plate has a planar front surface and a planar rear surface. The support plate further includes opposed short top and bottom edges and opposed long side edges. A trough portion is secured to the planar front surface of the support plate upwardly of the short lower edge thereof. The trough portion includes an open upper end and a closed lower end. The trough portion has a width essentially five times greater than a width of the support plate. A plurality of support rods extend orthogonally outward from the front surface of the support plate downwardly of the short upper edge thereof. The support rods each have a length essentially half of the width of the trough portion. The support rods each have a vertically oriented, diamond-shaped hanger portion secured to a free end thereof. The vertically oriented hanger portions are adapted for supporting clothing thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hanging system for wet bathing suits which has all the advantages of the prior art drip catching devices and none of the disadvantages.

It is another object of the present invention to provide a new and improved hanging system for wet bathing suits which may be easily and efficiently manufactured and marketed.

It is a further object of the present invention to provide a new and improved hanging system for wet bathing suits which is of durable and reliable construction.

An even further object of the present invention is to provide a new and improved hanging system for wet bathing suits which is susceptible of a low cost of manufacture with regard to both materials and labor, and which accordingly is then susceptible of low prices of sale to the consuming public, thereby making such a hanging system for wet bathing suits economically available to the buying public.

Even still another object of the present invention is to provide a new and improved hanging system for wet bathing suits for supporting wet bathing suits to allow for them to dry out without dripping on a floor area.

Lastly, it is an object of the present invention to provide a new and improved hanging system for wet bathing suits including a support plate. A trough portion is secured to the support plate upwardly of a lower edge thereof. A plurality of support rods extend orthogonally outward from the support x plate downwardly of an upper edge thereof for supporting clothing thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
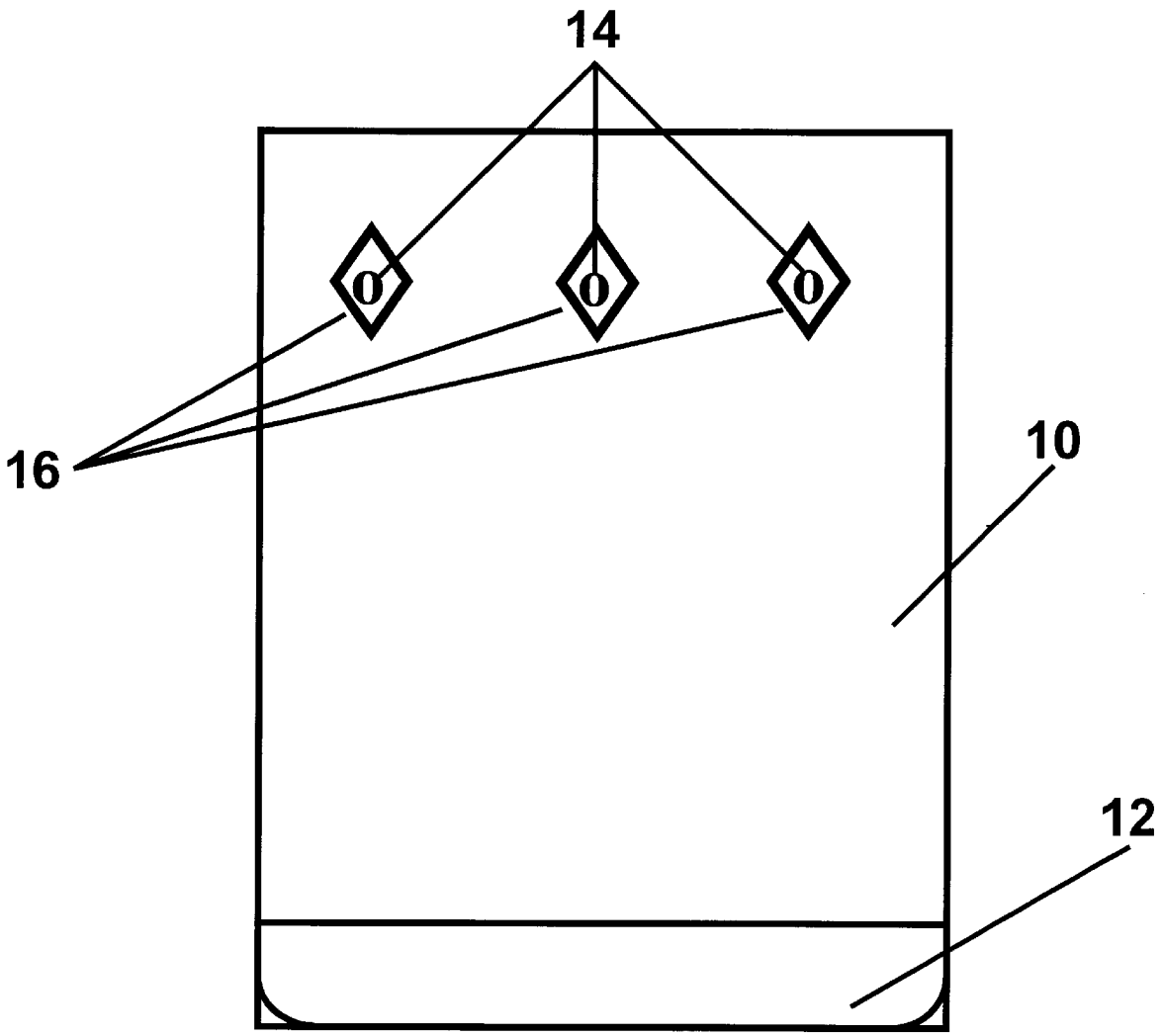
FIG. 1 is a front view of the preferred embodiment of the hanging system for wet bathing suits constructed in accordance with the principles of the present invention.
Figure 3:
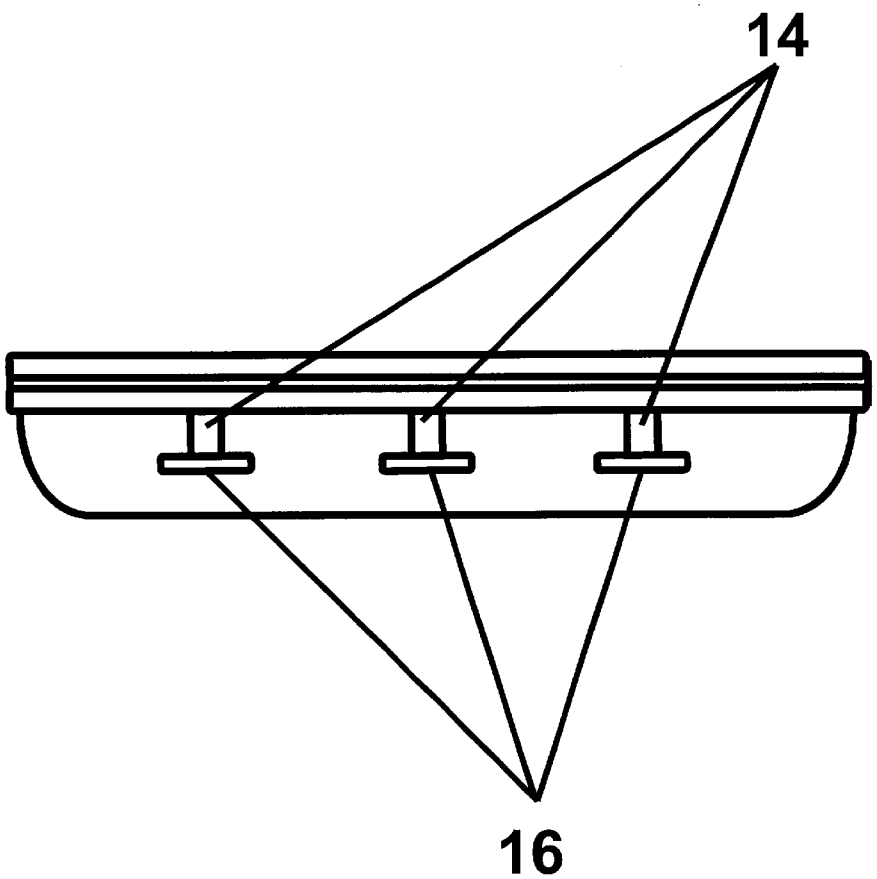
FIG. 3 is top plan view of the present invention.
Figure 2:
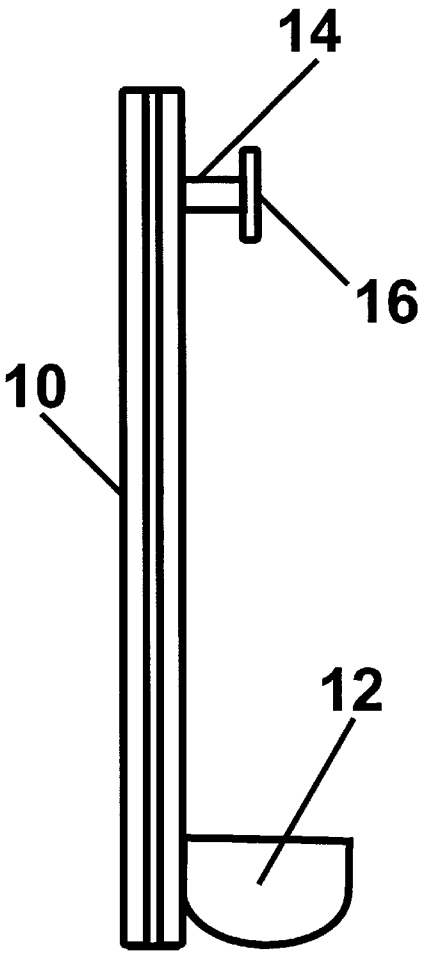
FIG. 2 is a side elevation view of the present invention.

With reference now to the drawings, and in particular, to FIGS. 1 through 3 thereof, the preferred embodiment of the new and improved hanging system for wet bathing suits embodying the principles and concepts of the present invention and generally designated by the reference number 10 will be described.

Specifically, it will be noted in the various Figures that the device relates to a hanging system for wet bathing suits for supporting wet bathing suits to allow for then to dry out without dripping on a floor area. In its broadest context, the device consists of a support plate, a trough portion and a plurality of support rods. Such components are individually configured and correlated with respect to each other so as to attain the desired objective.

The support plate 10 has a generally rectangular configuration. The support plate 10 has a planar front surface and a planar rear surface. The support plate 10 further includes opposed short top and bottom edges and opposed long side edges.

A trough portion 12 is secured to the planar front surface of the support plate 10 upwardly of the short lower edge thereof. The trough portion 12 includes an open upper end and a closed lower end. The trough portion 12 has a width essentially five times greater than a width of the support plate 10. Alternately, the trough portion could contain an absorbent material on an interior surface of the closed lower end.

A plurality of support rods 14 extend orthogonally outward from the front surface of the support plate 10 downwardly of the short upper edge thereof. The support rods 14 each have a length essentially half of the width of the trough portion 12. The support rods 14 each have a vertically oriented, diamond-shaped hanger portion 16 secured to a free end thereof. The vertically oriented, diamond-shaped hanger portions 16 are adapted for supporting clothing thereon. The hanger portions 16 will support the wet clothing thereon with the trough portion 12 positioned below the hanging clothing. Thus, any water dripping from the clothes will be caught within the trough portion 12. The caught water could then be dumped out into a sink or if absorbent material is disposed within the trough portion 12, such dumping would not be necessary.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hanging system for wet bathing suits for supporting wet bathing suits to allow for them to dry out without dripping on a floor area comprising, in combination:

a support plate having a generally rectangular configuration, the support plate having a planar front surface and a planar rear surface, the support plate further including opposed short top and bottom edges and opposed long side edges;

a trough portion secured to the planar front surface of the support plate upwardly of the short lower edge thereof, the trough portion including an open upper end and a closed lower end, the trough portion having a width essentially five times greater than a width of the support plate; and a plurality of support rods extending orthogonally outward from the front surface of the support plate downwardly of the short upper edge thereof, the support rods each having a length essentially half of the width of the trough portion, the support rods each having a vertically oriented, diamond-shaped hanger portion secured to a free end thereof, the vertically oriented, diamond-shaped hanger portions being adapted for supporting clothing thereon.

2. A hanging system for wet bathing suits comprising, in combination:

a support plate;

a trough portion secured to the support plate upwardly of a lower edge thereof; and a plurality of support rods extending orthogonally outward from the support plate downwardly of an upper edge thereof for supporting clothing thereon, support rods each having a length essentially half of the width of the trough portion; and said support rods each having a vertically oriented, diamond-shaped hanger portion secured to a free end thereof, the vertically oriented, diamond-shaped hanger portions being adapted for supporting clothing thereon.

3. The hanging system for wet bathing suits as set forth in claim 2 wherein the support plate had a generally rectangular configuration with a planar front surface and a planar rear surface, the support plate further includes opposed short top and bottom edges and opposed long side edges.

4. The hanging system for wet bathing suits as set forth in claim 2 wherein the trough portion includes an open upper end and a closed lower end.

5. The hanging system for bathing suits as set forth in claim 4 wherein the trough portion has a width essentially five times greater than a width of the support plate.

* * * * *